US005957678A

United States Patent [19]

Endoh et al.

[11] Patent Number: 5,957,678

[45] Date of Patent: Sep. 28, 1999

[54] COMBUSTION TYPE HARMFUL SUBSTANCE REMOVING APPARATUS

[75] Inventors: Fumitaka Endoh; Maya Yamada; Shuichi Koseki; Toshio Suwa; Shinichi Miyake; Akihiko Nitta, all of Yamanashi, Japan

[73] Assignee: Nippon Sanso Corporation, Tokyo, Japan

[21] Appl. No.: 09/051,458

[22] PCT Filed: Aug. 11, 1997

[86] PCT No.: PCT/JP97/02801

§ 371 Date: Apr. 13, 1998

§ 102(e) Date: Apr. 13, 1998

[87] PCT Pub. No.: WO98/06978

PCT Pub. Date: Feb. 19, 1998

[30] Foreign Application Priority Data

Aug. 14, 1996 [JP] Japan ..... 8-214731
Jul. 25, 1997 [JP] Japan ..... 9-199659

[51] Int. Cl.[6] ..... F23D 14/20

[52] U.S. Cl. ..... 431/5; 431/187; 431/353; 431/243

[58] Field of Search ..... 431/181, 187, 431/5, 11, 242, 243, 349, 350, 353; 239/544, 423, 424, 422, 433; 110/260, 261, 262, 263, 264; 423/336

[56] References Cited

U.S. PATENT DOCUMENTS

| | | | |
|---|---|---|---|
| 4,443,228 | 4/1984 | Schlinger | 239/422 |
| 4,801,437 | 1/1989 | Konagaya et al. . | |
| 5,123,836 | 6/1992 | Yoneda et al. | 431/5 |
| 5,308,239 | 5/1994 | Bazarian et al. | 431/187 |

FOREIGN PATENT DOCUMENTS

| | | |
|---|---|---|
| 0 572 693 A1 | 12/1993 | European Pat. Off. . |
| 0 572 693 B1 | 9/1994 | European Pat. Off. . |
| 62-134414 | 6/1987 | Japan . |
| 6-26635 | 2/1994 | Japan . |
| 8-121728 | 5/1996 | Japan . |

*Primary Examiner*—Ira S. Lazarus
*Assistant Examiner*—Sara Raab
*Attorney, Agent, or Firm*—Armstrong, Westerman, Hattori, McLeland & Naughton

[57] ABSTRACT

A combustion type detoxifying apparatus which carries out detoxifying treatment of a raw gas containing toxic components injected through a burner (3) into a combustion chamber (1) by allowing the toxic components to burn or undergo pyrolysis. The burner (3) has a raw gas nozzle (32*a*) for injecting the raw gas, a lift gas nozzle (32*b*) for injecting an inert gas, a raw gas combustion assisting gas nozzle (32*c*) for injecting a gas for assisting combustion of combustible components in the raw gas, a fuel gas combustion assisting gas nozzle (32*d*) for injecting a gas for assisting combustion of the fuel gas and a fuel gas nozzle (32*e*) for injecting the fuel gas.

9 Claims, 10 Drawing Sheets

COMBUSTION TYPE HARMFUL SUBSTANCE REMOVING APPARATUS

TECHNICAL FIELD

The present invention relates to a combustion type detoxifying apparatus, more particularly to a gas treating apparatus for detoxifying toxic components such as toxic gases, combustible gases and corrosive gases which are contained in raw gases such as exhaust gases to be exhausted from systems for producing semiconductors or LCDs by allowing such components to burn or undergo pyrolysis.

Since gases containing combustible or combustion-assisting toxic components are exhausted as exhaust gases from systems for producing semiconductors or LCDs, these exhaust gases should be subjected to treatments for removing such toxic components (detoxifying treatment) before they are exhausted. A combustion type detoxifying apparatus is known as an apparatus for carrying out such detoxifying treatment of exhaust gases.

This combustion type detoxifying apparatus carries out a detoxifying treatment by allowing various kinds of toxic components contained in an exhaust gas to burn or undergo pyrolysis using a burner provided in a combustion chamber, and a multi-wall pipe type burner consisting of nozzles for injecting an exhaust gas, a combustion assisting gas, etc., which are arranged concentrically, is usually employed as the burner.

As such a multi-wall pipe type burner, there is employed a quadruple-wall pipe type burner consisting of an exhaust gas nozzle for injecting the exhaust gas, which is located at the center, a lift gas nozzle for injecting a lift gas for lifting flames to be formed at the nozzle tip, which is arranged to surround the exhaust gas nozzle, an exhaust gas combustion assisting gas nozzle for injecting a gas for assisting combustion of combustible components in the exhaust gas, which is arranged to surround the lift gas nozzle, and a combustion nozzle for injecting a mixed gas of a fuel gas and a combustion assisting gas, which is arranged to surround the exhaust gas combustion assisting gas nozzle.

However, a problem in this quadruple-wall pipe type burner is that flames of the burner can flash back, since a fuel gas and a combustion assisting gas which are to be injected from the combustion nozzle are mixed at an appropriate rate beforehand, and the resulting mixed gas is supplied to the burner. Accordingly, it is necessary to incorporate an equipment and the like for preventing such flash-back, which increases costs.

Under such circumstances, an objective of the present invention is to provide a combustion type detoxifying apparatus equipped with a multi-wall pipe type burner having a structure which can give a stable combustion state without causing flash-back.

DISCLOSURE OF THE INVENTION

In the combustion type detoxifying apparatus according to the present invention, which carries out detoxification of a raw gas containing toxic components injected through a burner into a combustion chamber by allowing the toxic components to burn or undergo pyrolysis, the burner is a multi-wall pipe type burner having a raw gas nozzle for injecting the raw gas, a lift gas nozzle for injecting an inert gas formed to surround the raw gas nozzle, a raw gas combustion assisting gas nozzle for injecting a gas for assisting combustion of combustible components in the raw gas formed to surround the lift gas nozzle, a fuel gas combustion assisting gas nozzle for injecting a gas for assisting combustion of a fuel gas formed to surround the raw gas combustion assisting gas nozzle, and a fuel gas nozzle for injecting the fuel gas.

Incidentally, either the fuel gas combustion assisting gas nozzle or the fuel gas nozzle may be located inside the other.

According to this constitution, since the fuel gas combustion assisting gas and the fuel gas are injected from different nozzles respectively, flash-back can be prevented from occurring at the burner using a simple structure, and a combustion detoxifying treatment of an exhaust gas can be carried out safely in a stable state.

Further, according to the present invention, since the burner is attached to the combustion chamber via a pre-combustion chamber having a capacity which is smaller than that of the combustion chamber, burning or pyrolysis of the toxic components contained in the raw gas can be carried out efficiently.

Further, according to the present invention, since the combustion assisting gas is injected from the fuel gas combustion assisting gas nozzle at a flow rate which is the same as or higher than the flow rate of the fuel gas to be injected from the fuel gas nozzle, combustion of the mixture of these two gases can be carried out more efficiently to form flames which envelope flames formed at the center by combustion of toxic components, thus enhancing the effect of the detoxification treatment.

Further, according to the present invention, since the tips of the raw gas nozzle, lift gas nozzle and raw gas combustion assisting gas nozzle of the burner attached to the combustion chamber via the pre-combustion chamber protrude beyond the tips of the fuel gas combustion assisting gas nozzle and fuel gas nozzle, the fuel gas and the fuel gas combustion assisting gas are mixed fully in the space defined between the inner circumferential wall of the pre-combustion chamber and the protrusion of the burner. Accordingly, the burner forms stable flames even if the flow rate of the raw gas fluctuates, and powders formed during combustion do not deposit on the inner circumferential wall of the pre-combustion chamber. Thus, the raw gas can be treated safely in a stable state, and the frequency of maintenance service can be reduced to improve the operation rate of the apparatus.

Further, according to the present invention, the tip of the fuel gas combustion assisting gas nozzle and that of the fuel gas nozzle are formed to constitute an inverted V shape such that the nozzle holes of these nozzles may open on the walls of the inverted V-shaped groove respectively to oppose each other. Thus, the diffusion states of the fuel gas combustion assisting gas and fuel gas to be injected from these nozzles can be adjusted by suitably setting the angles of these walls depending on the gas flow rates and the like, so that more preferred mixing and combustion states can be obtained.

Further, according to the present invention, since the combustion chamber has on the outer circumference a gas preheating passage for preheating at least a part of gases to be introduced to the burner, the heat generated by combustion can be utilized effectively by incorporating such a simple structure into the apparatus, and thus reduction in the equipment installation space and cost can be achieved. Further, the combustion chamber can be cooled by the gas to be preheated, and also the amount of the fuel to be consumed can be lowered by the heat recovery.

BEST MODE FOR CARRYING OUT THE INVENTION

Figure 1:
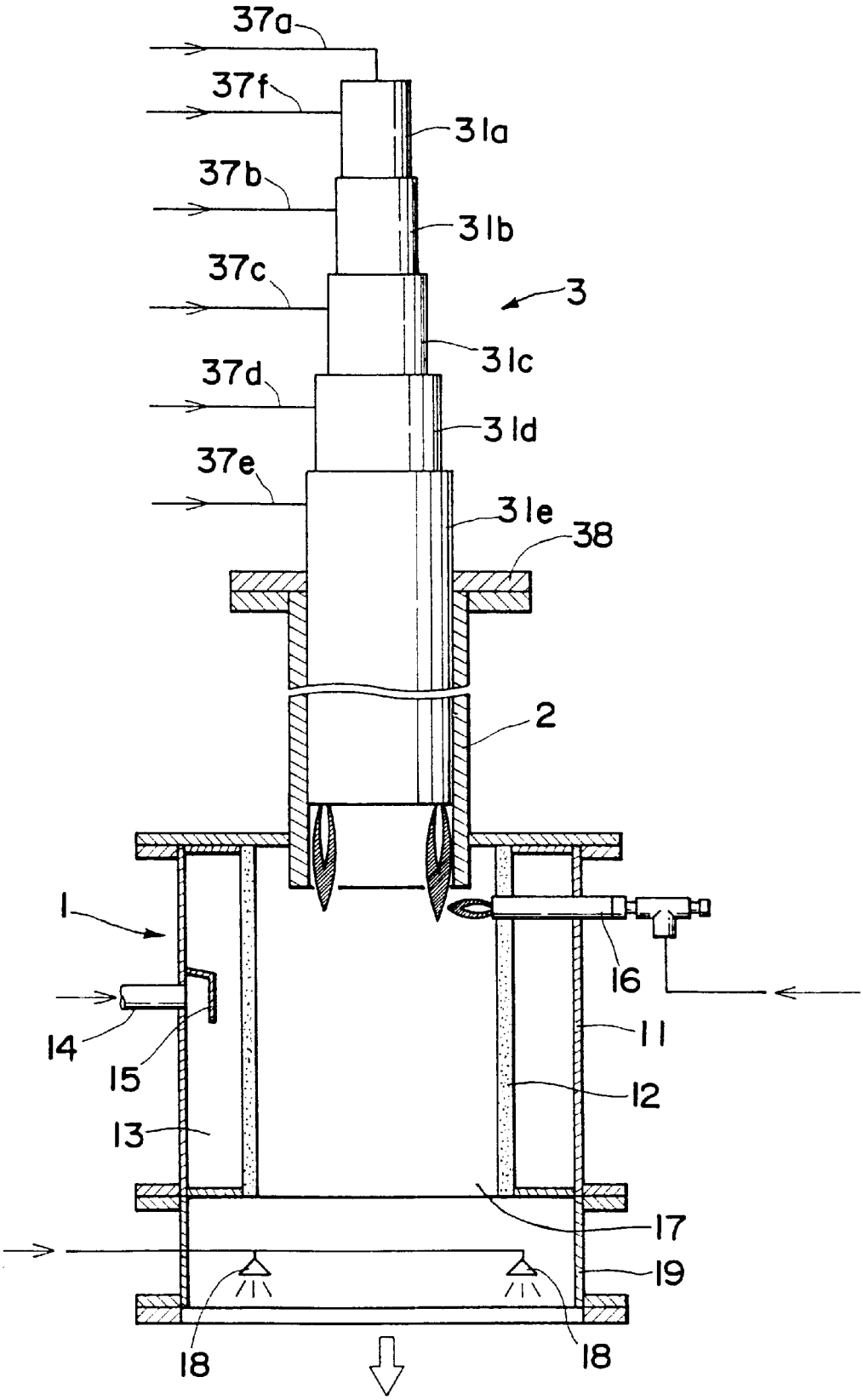
FIG. 1 is a cross-sectional view showing a combustion type detoxifying apparatus according to a first embodiment of the present invention.

Embodiments of the present invention will be described below more specifically referring to the drawings.

First, a combustion type detoxifying apparatus according to a first embodiment of the present invention shown in FIGS. 1 to 3 will be described.

This combustion type detoxifying apparatus contains a combustion chamber 1, a pre-combustion chamber 2 located at the top of the combustion chamber 1 and a burner 3 attached to the pre-combustion chamber 2.

The combustion chamber 1 has a double-wall structure containing a cylindrical outer barrel 11 made of an ordinary metallic material and the like and a cylindrical inner barrel 12 made of a porous material which are arranged concentrically.

The outer barrel 11 is provided with a fluid nozzle 14 for introducing a pressure fluid such as compressed air into a space 13 defined between the outer barrel 11 and the inner barrel 12. A baffle plate 15 is disposed on the inner surface of the outer barrel 11 so as to face the tip of the fluid nozzle 14. The baffle plate 15 is disposed so as to diffuse the pressure fluid to be introduced through the fluid nozzle 14 throughout the space 13.

The combustion chamber 1 has a constitution such that powders may be prevented from depositing on the inner surface of the inner barrel 12 by introducing the pressure fluid through the fluid nozzle 14 into the space 13 and allowing the pressure fluid to burst inward through the pores of the porous material constituting the inner barrel 12. Accordingly, even if powdery solid oxides are formed during combustion treatment of a raw gas or if powders are carried on the raw gas, such powders are not deposited on the inner surface of the inner barrel 12 to interfere with the combustion treatment, and thus the combustion treatment can be carried out in a stable state over an extended period.

An igniting pilot burner 16 is attached to the wall of the combustion chamber 1 at an upper position so as to penetrate the outer barrel 11 and the inner barrel 12. The pilot burner 16 is of the conventional type having a sparking plug, and a mixed gas of a fuel and a combustion assisting gas, e.g., propane gas and air, is ignited with the sparking plug to be burned and to light up a fuel gas injected from the burner 3 with the resulting flame.

The combustion chamber 1 has a lower opening 17 which is connected to an exhaust gas treating system (not shown) via a chamber 19 provided with spray nozzles 18 for spraying a coolant for cooling the combustion gas.

The lower part in the pre-combustion chamber 2 communicates with the upper part in the combustion chamber 1. The capacity of the pre-combustion chamber 2 is designed to be smaller than that of the combustion chamber 1.

The burner 3 is formed to have a quintuple-wall pipe structure consisting of five pipes 31*a*,31*b*,31*c*,31*d*,31*e* which are arranged concentrically. The inner space of the center pipe 31*a* and the spaces between every adjacent two pipes respectively constitute gas channels. The pipes have at the tips a raw gas nozzle 32*a* for injecting a raw gas containing toxic components, a lift gas nozzle 32*b* for injecting an inert gas employed as a lift gas, a raw gas combustion assisting gas nozzle 32*c* for injecting a gas for assisting combustion of combustible components in the raw gas, a fuel gas combustion assisting gas nozzle 32*d* for injecting a gas for assisting combustion of a fuel gas, and a fuel gas nozzle 32*e* for injecting the fuel gas, respectively which are arranged outward in this order.

An annular nozzle member 33 serving also as a spacer is fitted in the fuel gas combustion assisting gas nozzle 32*d* and the fuel gas nozzle 32*e*. The fuel gas combustion assisting gas and fuel gas are injected through nozzle holes 33*a*,33*b*, respectively formed in the nozzle member 33. An annular slit or a multiplicity of holes arranged in the circumferential direction constitute each nozzle hole 33*a*(33*b*).

A blocking member 34*a* is fitted to the proximal end portion of the center pipe 31*a*, while annular blocking members 34*b*,34*c*,34*d*,34*e*, for blocking the rear ends of the gas channels formed between the pipes and for retaining the pipes at predetermined intervals, are fitted to the proximal end portions of the pipes 31*b*,31*c*,31*d*,31*e* respectively. Spacers 35 for maintaining the intervals may be fitted as necessary at the middle portions of the pipes.

The pipe 31*a* has at the proximal end side a raw gas supply pipe 37*a* for supplying a raw gas to a raw gas channel 36*a*; the pipe 31*b* has at the proximal end side a lift gas supply pipe 37*b* for supplying an inert gas to a lift gas channel 36*b*; the pipe 31*c* has at the proximal end side a raw gas combustion assisting gas supply pipe 37*c* for supplying a raw gas combustion assisting gas to a raw gas combustion assisting gas supply channel 36*c*; the pipe 31*d* has at the proximal end a fuel gas combustion assisting gas supply pipe 37*d* for supplying a fuel gas combustion assisting gas to a fuel gas combustion assisting gas channel 36*d*, and the pipe 31*e* has at the proximal end side a fuel gas supply pipe 37*e* for supplying a fuel gas to a fuel gas channel 36*e*. The pipe 31*a* also has at the proximal end side an auxiliary fuel supply pipe 37*f*. The auxiliary fuel supply pipe 37*f* is incorporated, as necessary, so as to supply a combustible gas such as hydrogen into the raw gas when the raw gas contains small amounts of combustible components.

The burner 3 has on its barrel a flange 38 which is used when the burner 3 is attached to the pre-combustion chamber 2. The burner 3 is attached via the pre-combustion chamber 2 to the central portion at the top of the combustion chamber 1.

When a raw gas containing toxic components is subjected as the raw gas to combustion detoxifying treatment in the constituted detoxifying apparatus, the raw gas to be treated is injected from raw gas nozzle 32*a*, an insert gas such as nitrogen and argon is injected from the lift gas nozzle 32*b*, an oxygen-containing gas such as nitrogen and argon is injected from the raw gas combustion assisting gas nozzle 32*c*, another oxygen-containing gas is injected from the raw gas combustion assisting 32*d*, a fuel gas such as propane gas is injected from the fuel gas nozzle 32*e*, and a natural gas and hydrogen are also injected, and the gases are ignited with the flame of the pilot burner 16.

In this constitution, since the burner 3 is designed such that the fuel gas and the fuel gas combustion assisting gas may be injected through separate nozzles, respectively, and burned flash-back, which can occur, in the conventional burner, when the fuel gas and the fuel gas combustion assisting gas are mixed before injection through the nozzle, can be avoided, and there is no need to incorporate an equipment and the like for preventing such flash-back, leading to a reduction in the equipment costs. Incidentally, a similar flash-back preventing effect can be obtained even when the positional relationship of supplying and injecting the fuel gas combustion assisting gas and the fuel gas is reversed to locate the fuel gas nozzle inside and the fuel gas combustion assisting gas nozzle outside.

The fuel gas combustion assisting gas and the fuel gas injected from the fuel gas combustion assisting gas nozzle 32*d* and the fuel gas nozzle 32*e* respectively can be mixed and burned efficiently by providing the pre-combustion chamber 2. Particularly, mixing and burning of these two gases can be carried out more efficiently by injecting the fuel gas combustion assisting gas through the fuel gas combustion assisting gas nozzle 32*d* at a flow rate which is the same or 3 to 10 times as high as that of the fuel gas to be injected through the fuel gas nozzle 32*e*. Thus, the flames formed at the central portion by combustion of the toxic components are enveloped with the flames formed by combustion of the fuel gas and the fuel gas combustion assisting gas, so that the effect of the detoxifying treatment can be enhanced.

Next, another embodiment of the burner to be employed in the first combustion type detoxifying apparatus shown in FIG. 1 will be described referring to FIG. 4.

Figure 3:
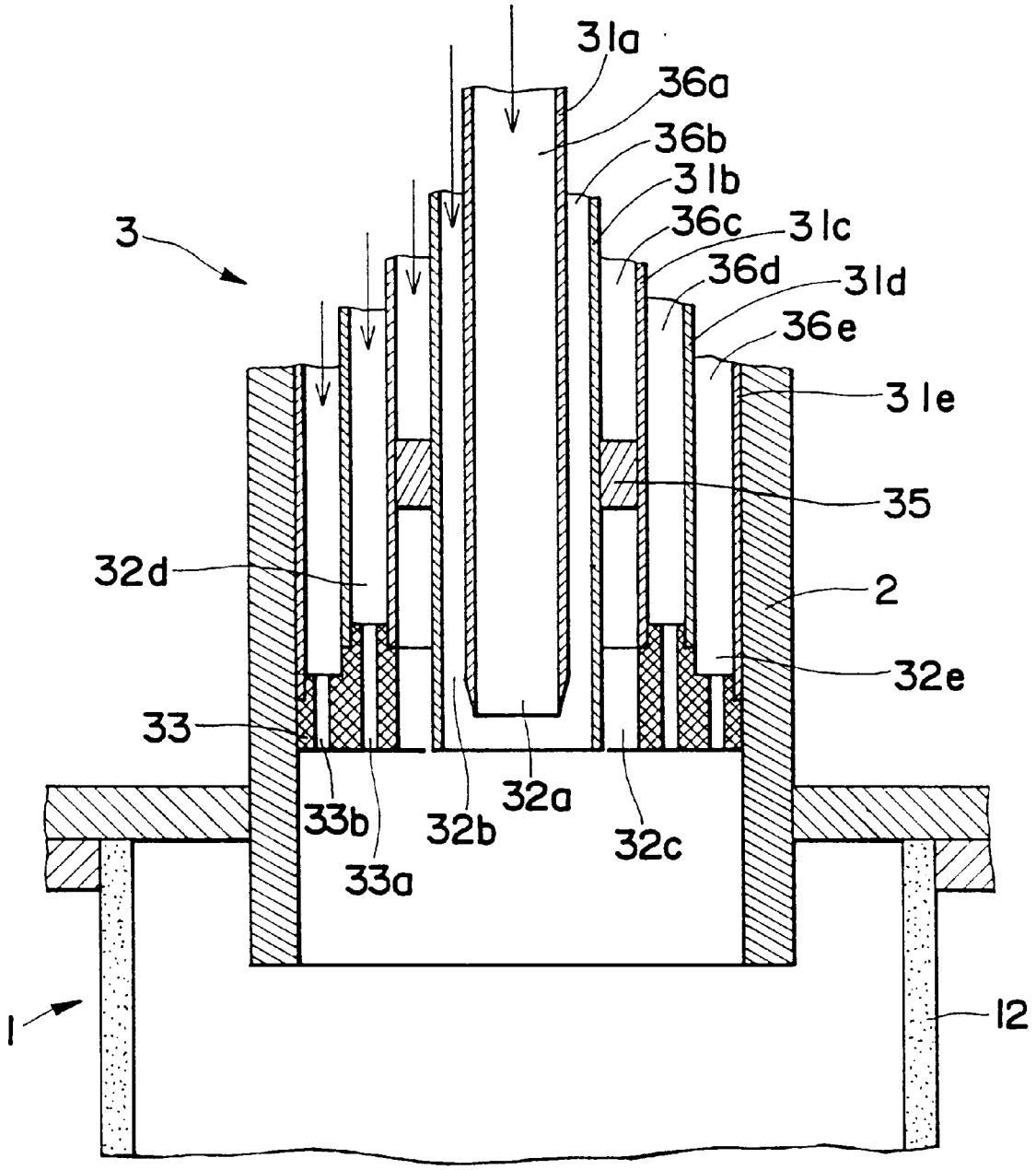
FIG. 3 is a cross-sectional view showing a nozzle portion of the burner shown in FIG. 2.
Figure 4:
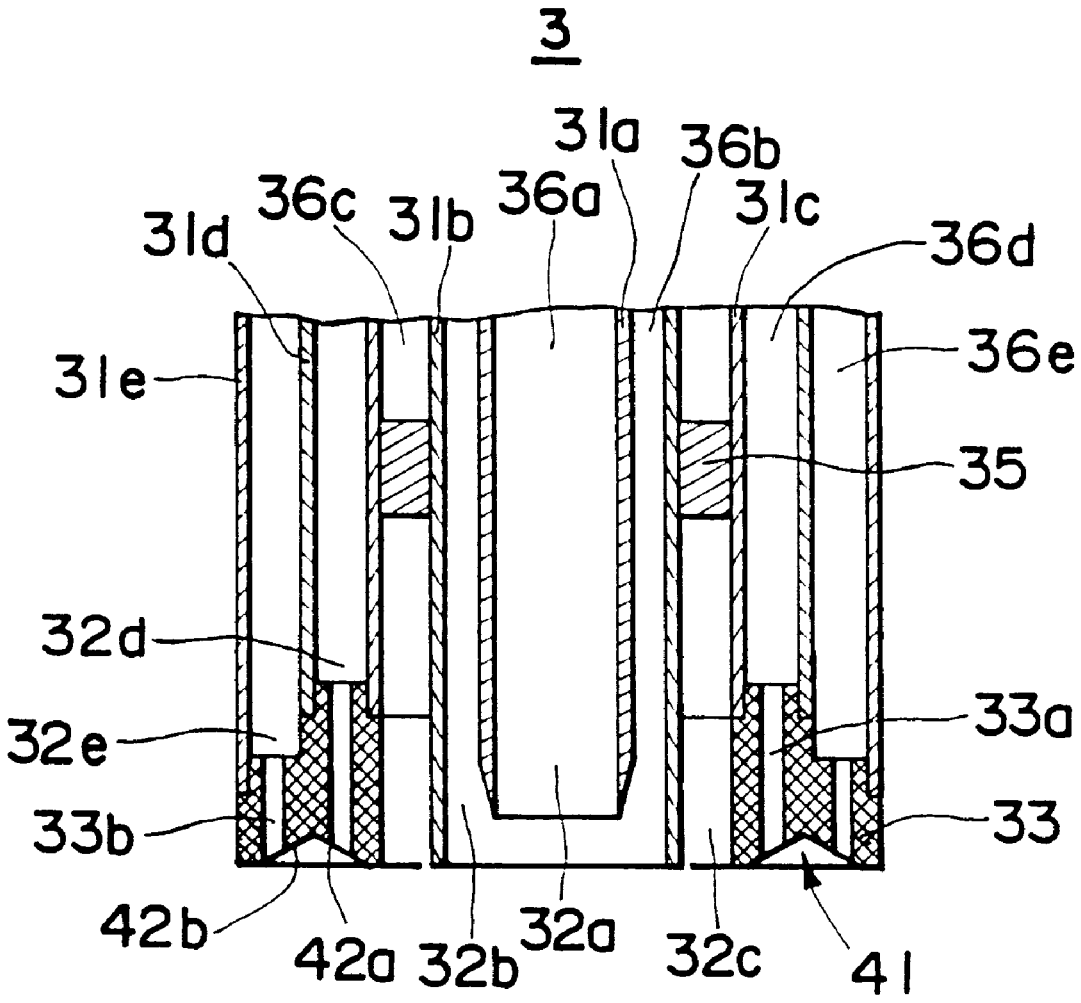
FIG. 4 is a cross-sectional view showing another nozzle portion of the burner employable in the combustion type detoxifying apparatus of the first embodiment.

In the burner 3 shown in FIG. 4, the nozzle hole of the fuel gas combustion assisting gas nozzle 32*d* and that of the fuel gas nozzle 32*e* are located on the walls of an inverted V-shaped groove to oppose each other. More specifically, the inverted V-shaped groove 41 is formed at the distal end face of the nozzle member 33, and a nozzle hole 33*a* of the fuel gas combustion assisting gas nozzle 32*d* opens to the inner circumferential wall 42*a* of the groove 41, while a nozzle hole 33*b* of the fuel gas nozzle 32*e* opens to the outer circumferential wall 42*b* of the groove 41. Constitutions of other parts of the burner are substantially the same as those of the counterparts in the burner shown in FIGS. 1 to 3.

Diffusion states of the fuel gas combustion assisting gas and fuel gas injected from the nozzles 32*d* and 32*e* respectively can be adjusted by appropriately setting the angles of the walls 42*a*,42*b* depending on the gas flow rates etc., and by providing more preferred mixing and combustion state.

Next, a combustion type detoxifying apparatus according to a second embodiment of the present invention shown in FIG. 5 will be described.

This combustion type detoxifying apparatus, like that of the first embodiment shown in FIG. 1, is provided with a combustion chamber 1, a pre-combustion chamber 2 disposed at the top of the combustion chamber 1 and a burner 3 attached to the pre-combustion chamber 2.

The combustion chamber 1 in this embodiment is the same as that shown in FIG. 1, except that the cylindrical inner barrel made of a porous material, the fluid nozzle and the baffle plate are omitted.

Further, the pre-combustion chamber 2 in this embodiment is surrounded by a cylindrical cooling jacket 21 to which a coolant is distributed to cool the circumferential wall 22 of the pre-combustion chamber 2.

In the burner 3 of this embodiment, the tips of a raw gas nozzle 32*a*, a lift gas nozzle 32*b* and a raw gas combustion assisting gas nozzle 32*c* protrude beyond the tips of a fuel gas combustion assisting gas nozzle 32*d* and a fuel gas nozzle 32*e*. More specifically, the raw gas nozzle and the lift gas nozzle of the burner shown in FIGS. 1 to 3 are extended, and a cylindrical part 51 is connected to the front end of the nozzle member 33 to extend the raw gas combustion assisting gas. nozzle 32*c*. The outside diameter of the cylindrical part 51 is the same as the inside diameter of the fuel gas combustion assisting gas nozzle 32*d*. Other constitutions of the burner 3 are the same as the counterparts of the burner shown in FIG. 4.

The length of protrusion of the raw gas nozzle 32*a*, lift gas nozzle 32*b* and raw gas combustion assisting gas nozzle 32*c* is 5 mm or more, preferably 20 mm or more but is not so much that they protrude from the pre-combustion chamber 2.

This constitution of the burner 3 achieves sufficient mixing of a fuel gas and a fuel gas combustion assisting gas in the space defined between the inner wall surface of the pre-combustion chamber 2 and the cylindrical part 51, so that the burner forms stable flames, and powders occurring during combustion do not deposit on the inner wall surface of the pre-combustion chamber 2.

Accordingly, a raw gas can be treated safely in a stable state, and the frequency of maintenance service can be reduced to improve the operation rate of the apparatus.

Figure 2:
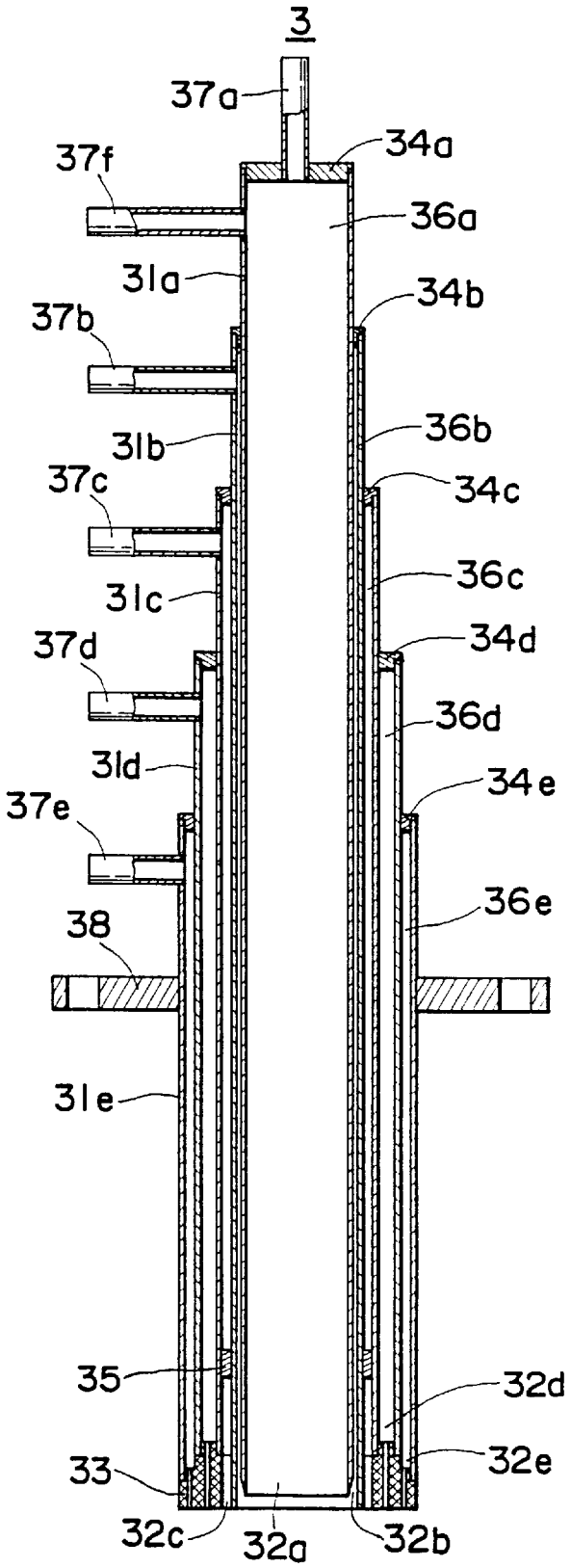
FIG. 2 is a cross-sectional view showing a burner employable in the combustion type detoxifying apparatus of the first embodiment.

While it is preferred to form an inverted V-shaped groove 41 at the tips of the fuel gas combustion assisting gas nozzle 32*d* and fuel gas nozzle 32*e*, like in the burner shown in FIG. 4, these nozzles may have flat nozzletips like in the burner shown in FIGS. 1 to 3.

Figure 5:
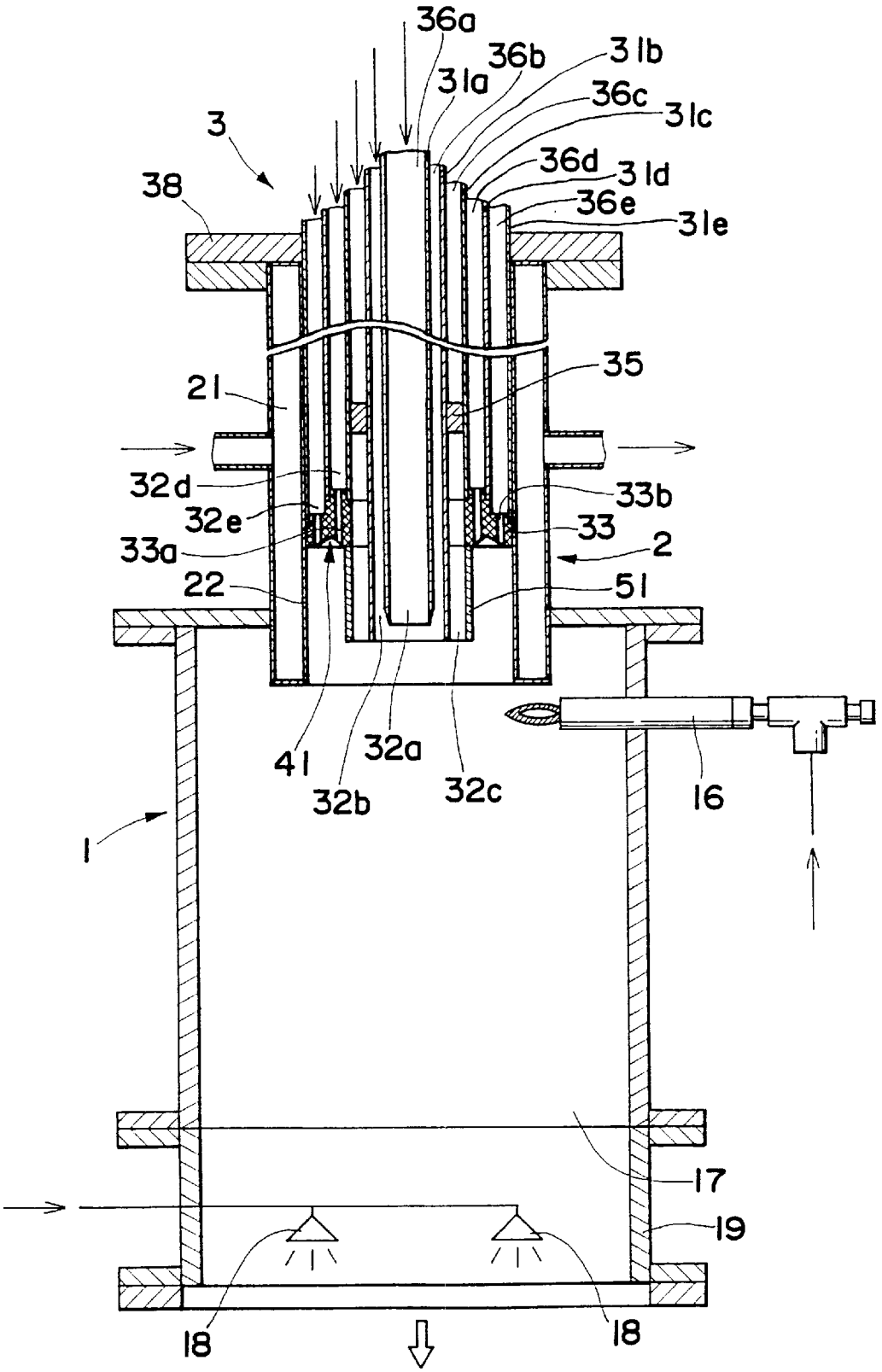
FIG. 5 is a cross-sectional view showing a combustion type detoxifying apparatus according to a second embodiment of the present invention.

Incidentally, in the burner shown in FIGS. 1 to 3 and those shown in FIGS. 4 and 5, the fuel gas nozzle 32*e* and the fuel gas channel 36*e* are located outside of the fuel gas combustion assisting gas nozzle 32*d* and the fuel gas combustion assisting gas channel 36*d*. However, there is no inconvenience at all if the fuel gas nozzle 32*e* and the fuel gas channel 36*e* are located inside the fuel gas combustion assisting gas nozzle 32*d* and the fuel gas combustion assisting gas channel 36*d*.

Figure 6:
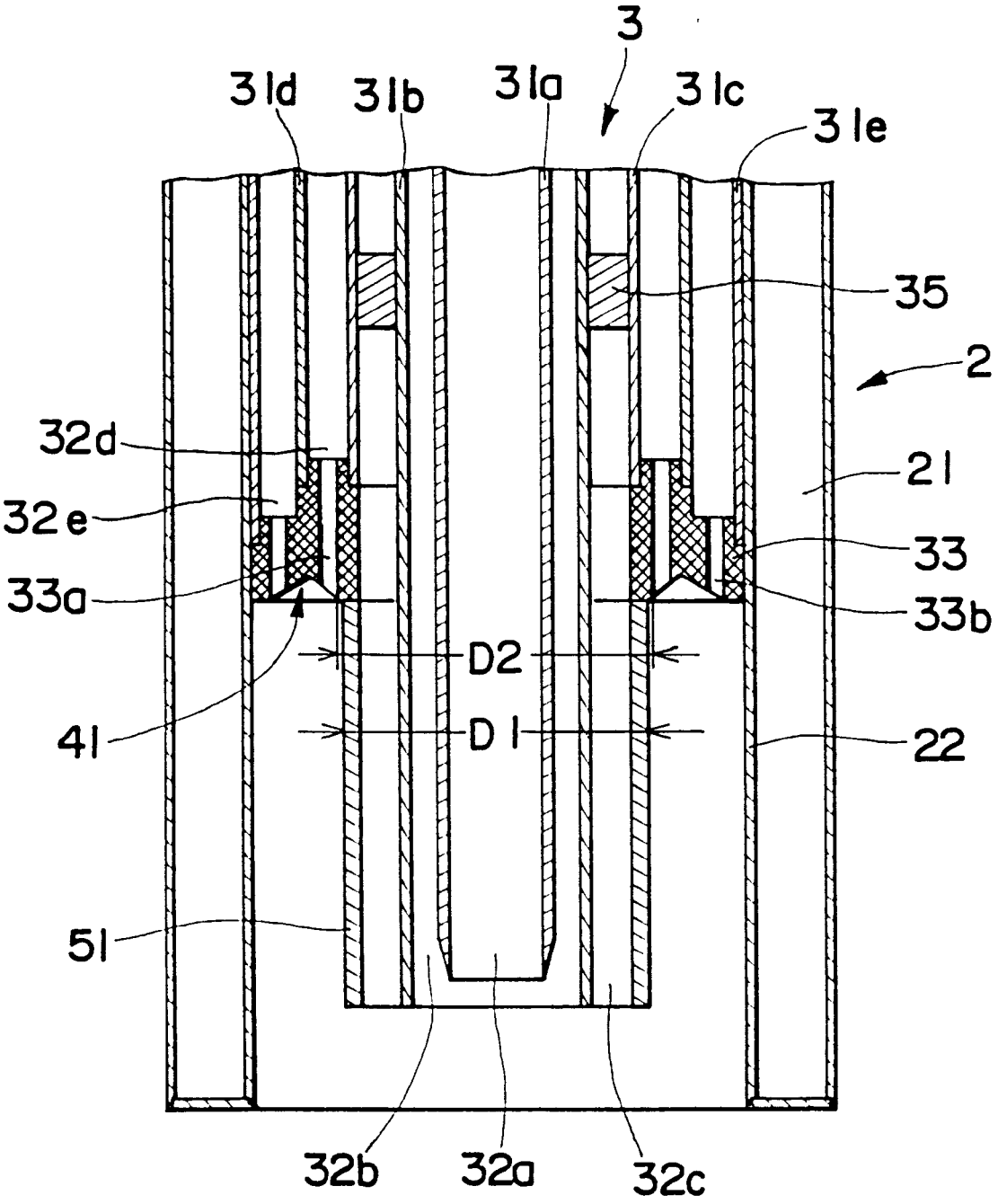
FIG. 6 is a cross-sectional view showing another nozzle portion of the burner employable in the combustion type detoxifying apparatus of the second embodiment.
Figure 7:
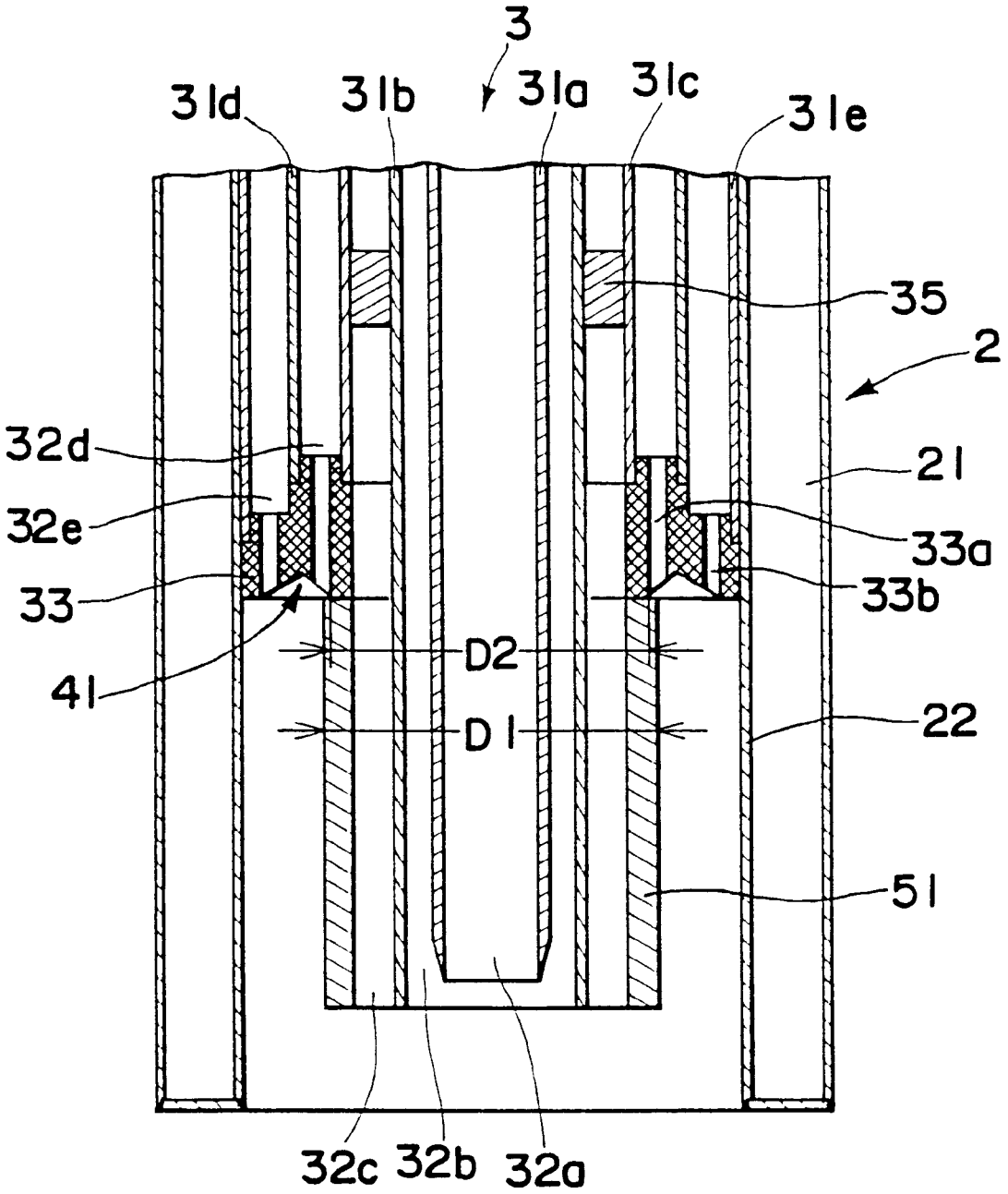
FIG. 7 is a cross-sectional view showing another nozzle portion of the burner employable in the combustion type detoxifying apparatus of the second embodiment.

FIG. 6 shows a burner 3 in which the outside diameter D1 of the cylindrical part 51 is slightly smaller than the inside diameter D2 of the nozzle hole 33*a* for injecting the fuel gas combustion assisting gas; whereas FIG. 7 shows a burner 3 in which the outside diameter D1 is slightly greater than the inside diameter D2. Other constitutions of these burners are the same as the counterparts of the burner shown in FIG. 5.

As described above, by reducing or increasing slightly the outside diameter D1 of the cylindrical part 51 relative to the inside diameter D2 of the nozzle hole 33*a* for injecting the fuel gas combustion assisting gas, the cylindrical part 51 is prevented from being burned by the flame of the burner and becoming red hot when the fuel gas nozzle 32*e* is located outside of the fuel gas combustion assisting gas nozzle 32*d*.

For example, in a burner having an outside diameter of 89 mm provided with a fuel gas combustion assisting gas injecting nozzle hole 33*a* having an inside diameter D2 of 71 mm and a cylindrical part 51 having a protrusion length of 60 mm, the cylindrical part 51 can be prevented from becoming red hot by reducing the outside diameter D1 thereof within the range of 2 mm or increasing it within the range of 1 mm relative to the inside diameter D2.

Incidentally, in the burners shown in FIGS. 6 and 7, the tips of the fuel gas combustion assisting gas nozzle 32*d* and fuel gas nozzle 32*e* may be flat like in the burner shown in FIGS. 1 to 3. There is no inconvenience at all even in these burners, if the fuel gas nozzle 32*e* is located inside the fuel gas combustion assisting gas nozzle 32*d*.

Next, a combustion type detoxifying apparatus according to a third embodiment of the present invention shown in FIG. 8 will be described.

This combustion type detoxifying apparatus, like that of the first embodiment shown in FIG. 1, is provided with a combustion chamber 1, a pre-combustion chamber 2 disposed at the top of the combustion chamber 1 and a burner 3 attached to the pre-combustion chamber 2.

The combustion chamber 1 of this embodiment is formed to have a double-wall structure consisting of a cylindrical outer barrel 11 and a cylindrical inner barrel 61 which are arranged concentrically, with a space serving as a gas preheating passage 62 being defined between the outer barrel 11 and the inner barrel 61. The outer barrel 11 and the inner barrel 61 are formed employing an ordinary metallic material and the like. To the gas pre-heating passage 62 are connected a raw gas combustion assisting gas introducing pipe 63 for introducing a raw gas combustion assisting gas into the gas preheating passage 62 and a raw gas combustion assisting gas supply pipe 37*c* for supplying the preheated raw gas combustion assisting gas to a raw gas combustion assisting gas channel of the burner 3. The combustion chamber 1 is provided on the wall thereof with a spray nozzle 64 for removing powders deposited on the inner surface of the inner barrel 61 which penetrates the outer barrel 11 and the inner barrel 61.

Other constitutions of the combustion chamber 1 and the constitutions of the pre-combustion chamber 2 and burner 3 are substantially the same as the counterparts shown in FIG. 1.

Figure 8:
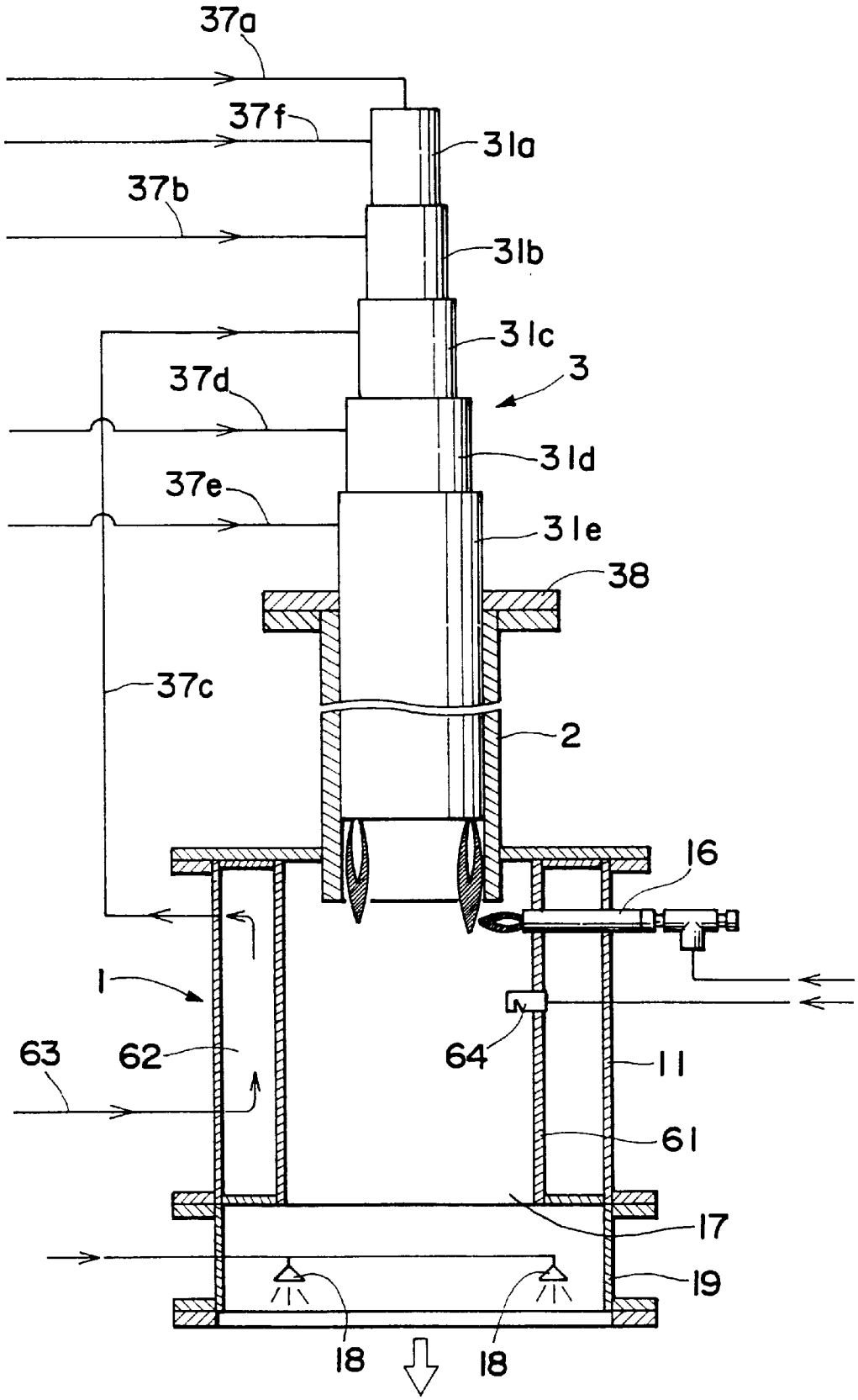
FIG. 8 is a cross-sectional view showing a combustion type detoxifying apparatus according to a third embodiment of the present invention.
Figure 9:
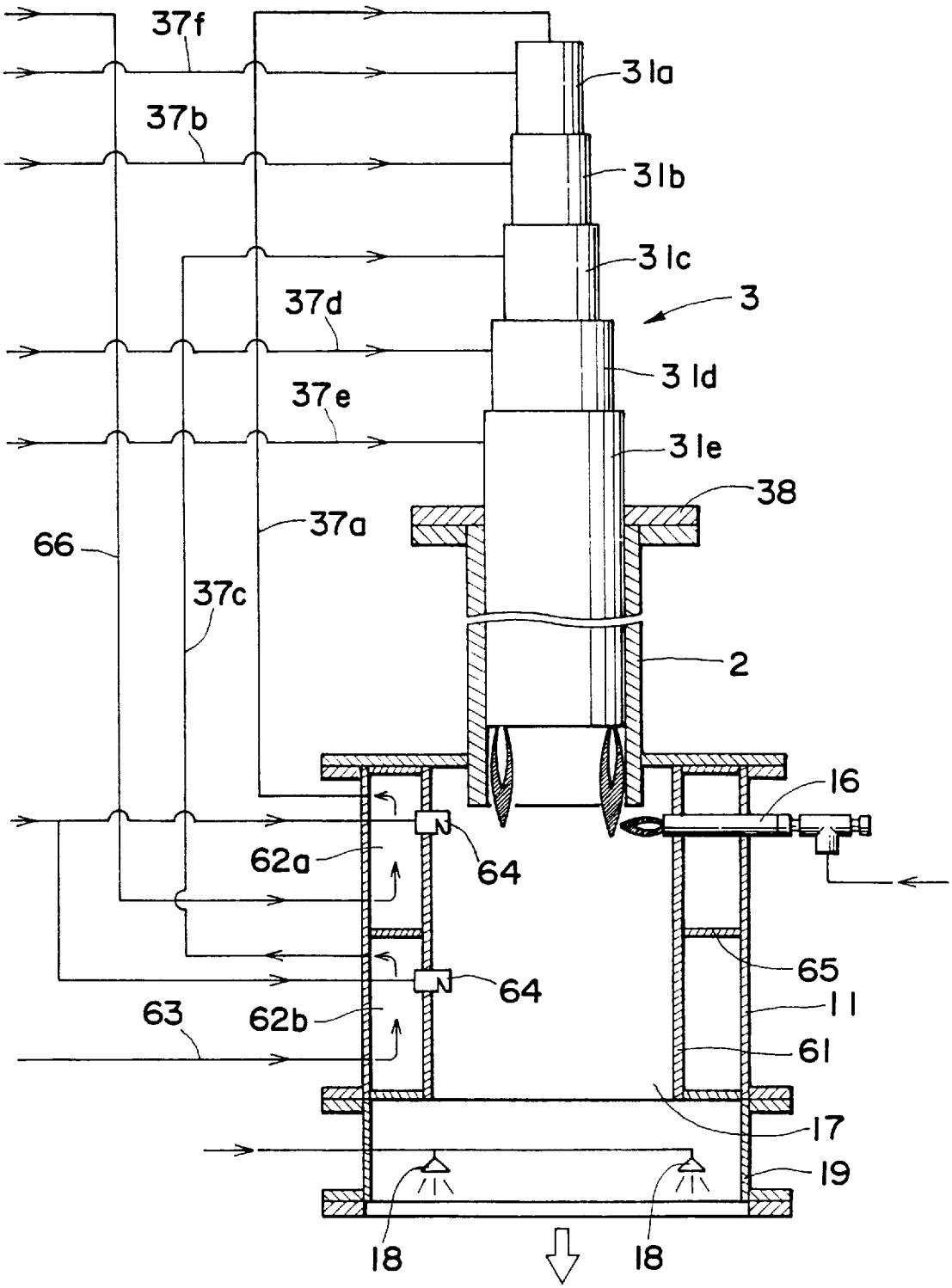
FIG. 9 is a cross-sectional view showing a combustion type detoxifying apparatus according to a fourth embodiment of the present invention.

FIG. 9 shows a combustion type detoxifying apparatus according to a fourth embodiment of the present invention, in which a partition 65 is disposed in the space defined between the outer barrel 11 and the inner barrel 61 in the combustion chamber 1 of the third embodiment shown in FIG. 8 to define gas preheating passages 62*a*,62*b*. To the gas preheating passage 62*a* are connected a raw gas introducing pipe 66 for introducing a raw gas to the preheating passage 62*a* and a raw gas supply pipe 37*a* for supplying the preheated raw gas to the raw gas channel of the burner 3. To the gas preheating passage 62*b* are connected a raw gas combustion assisting gas introducing pipe 63 and a raw gas combustion assisting gas supply pipe 37*c* like in the third embodiment shown in FIG. 8. Other constitutions of the combustion type detoxifying apparatus according to the fourth embodiment are substantially the same as the counterparts of the third embodiment.

As described above, in the third and fourth embodiments, combustion of the raw gas can be accelerated by preheating the raw gas and the raw gas combustion assisting gas with the heat generated by the combustion treatment before they are supplied to the burner 3, and thus, the detoxifying treatment can be carried out securely by increasing the combustion temperature, while fuel saving is achieved. Further, since the outer barrel 11 and inner barrel 61 of the combustion chamber 1 can be cooled with these gases, the exterior of the apparatus is prevented from becoming hot, leading to increased safety. In addition, since the gas preheating passages are formed to surround the combustion chamber 1 integrally therewith, the construction is inexpensive compared with a heat exchanger which is installed conventionally as an individual unit, and it requires substantially no extra installation space.

Deposition of powders such as of solid oxide occurring during combustion treatment of the raw gas on the inner circumferential surface of the combustion chamber causes not only a narrowing of the combustion chamber which lowers combustion efficiency, but also a drop in the heat transfer efficiency which reduces preheating efficiency, etc. However, since powders are removed by spraying air, water and the like suitably from the powder-removing spray nozzle 64, an efficient combustion detoxifying treatment can be continued in a stable state over a long time.

Meanwhile, in order to improve preheating efficiency, the heat transfer area may be enlarged by.providing fins and the like on the outer surface of the inner barrel 61. Further, the gas preheating passages may be formed by winding a pipe spirally around the outer barrel 11, and the number of such passages may be selected as desired.

The powder-removing spray nozzle 64 may be incorporated only in those cases where powdery solid oxides and the like are deposited during the combustion treatment on the inner circumferential surface of the combustion chamber, and the fluid to be a sprayed may be liquid such as water or a gas such as air and nitrogen gas.

Figure 10:
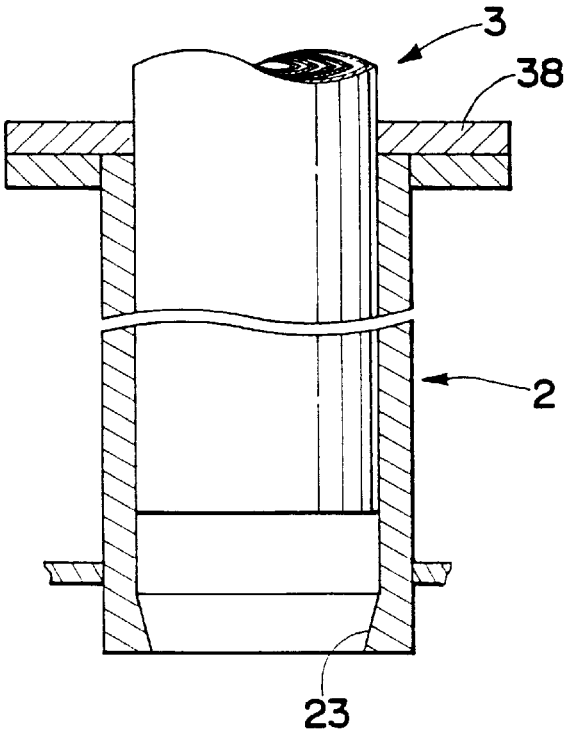
FIG. 10 is a cross-sectional view showing another embodiment of the pre-combustion chamber.
Figure 11:
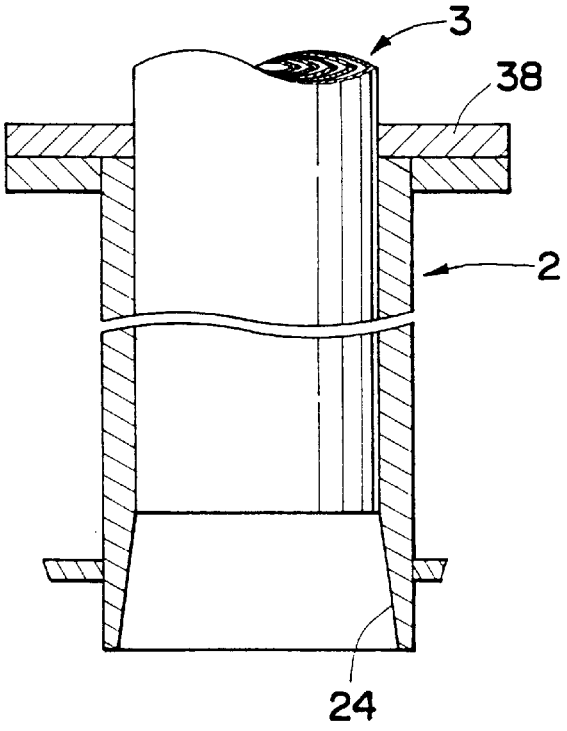
FIG. 11 is a cross-sectional view showing another embodiment of the pre-combustion chamber.

FIGS. 10 and 11 show pre-combustion chambers of other embodiments. In the pre-combustion chamber 2 shown in FIG. 10, the inner wall 23 is contracted at the tip; whereas in the pre-combustion chamber 2 shown in FIG. 11, the inner wall 24 is expanded at the tip.

As described above, the pre-combustion chamber can be formed to have a suitable configuration depending on the amounts and flow rates of various gases to be injected from the burner, the kinds of gases, the nozzle shape, etc. Thus, an optimum relationship can be secured between flames to be formed by combustion of the fuel gas at the tip of the burner and flames to be formed by combustion of an exhaust gas, further enhancing the detoxifying efficiency. Furthermore, the length of the pre-combustion chamber can be set suitably depending on the diameter of the burner, the amount and flow rate of each gas to be injected, etc. However, if the length of the pre-combustion chamber is smaller than ⅓ of the burner diameter, the effect of the pre-combustion chamber cannot be exhibited sufficiently, whereas if it is longer than twice the burner diameter, the pre-combustion chamber no more serves as the pre-combustion chamber, since it assumes a function as the combustion chamber.

As described in the above embodiments, while it is preferred, in the combustion type exhaust gas treating apparatus, that the burner 3 is attached to the combustion chamber 1 via the pre-combustion chamber 2, the burner 3 may be attached directly to the combustion chamber 1.

In the present invention, the configurations and structures of the combustion chambers and pre-combustion chambers including attachments are not to be limited to the above embodiments.

TEST EXAMPLE 1

A detoxifying treatment for removing silane was carried out employing a combustion type detoxifying apparatus having the structure shown in FIGS. 1 to 3. The combustion chamber 1 had an outer barrel 11 made of a stainless steel material and having an outside diameter of 200 mm, and an inner barrel 12 made of a sintered metal of stainless steel and having an outside diameter of 150 mm, a thickness of 3 mm and a nominal filtration accuracy of 100 μm. The combustion chamber 1 had a height of 300 mm. The burner 3 had an outside diameter of about 90 mm, and the length of the portion of the pre-combustion chamber 2 protruding beyond the tip of the burner 3 was 55 mm. Incidentally, as the pre-combustion chamber 2, one having a cooling jacket as shown in FIG. 5 was employed.

Gases were supplied to the burner 3 as follows: nitrogen gas ($N_2$) containing 3% of silane ($SiH_4$) to the raw gas channel 36*a* at a rate of 150 lit/min; nitrogen gas ($N_2$) to the lift gas channel 36*b* at a rate of 10 lit/min; air to the raw gas combustion assisting gas channel 36*c* at a rate of 100 lit/min; air to the fuel gas combustion assisting gas channel 36*d* at a rate of 125 lit/min; and propane gas (LPG) to the fuel gas channel 36*e* at a rate of 5 lit/min, respectively.

To the pilot burner 16 was supplied a gas formed by mixing 1 lit/min of propane gas and 22 lit/min of air. To the space defined between the outer barrel 11 and the inner barrel 12 of the combustion chamber 1 was supplied compressed air having a pressure of 4 $kg/cm_2G$ from the fluid nozzle 14 at a rate of 165 lit/min.

When the apparatus was operated under the above-described conditions for 24 hours, no flash-back occurred. Meanwhile, the silane concentration in the gas exhausted from an exhaust gas treating system was constantly less than 1/10 of the threshold limit value 5 ppm throughout the operation.

TEST EXAMPLE 2

A detoxifying treatment for removing silane was carried out employing a combustion type detoxifying apparatus having the structure shown in FIG. 5. The combustion chamber 1 had an outer barrel 11 made of a stainless steel material and having an outside diameter of 150 mm and a height of 300 mm. The burner 3 had an outside diameter of about 90 mm, and the length of protrusion of the raw gas nozzle 32*a*, lift gas nozzle 32*b* and raw gas combustion assisting gas nozzle 32*c* was 60 mm. The length of the portion of the burner 3 in the pre-combustion chamber 2 protruding beyond the tip of the fuel gas combustion assisting gas nozzle 32*d* and fuel gas nozzle 32*e* was 80 mm.

Gases were supplied to the burner 3 as follows: nitrogen gas containing 3% of silane to the raw gas channel 36*a* at a rate of 100 lit/min; nitrogen gas to the lift gas channel 36*b* at a rate of 10 lit/min; air to the raw gas combustion assisting gas channel 36*c* at a rate of 100 lit/min; air to the fuel gas combustion assisting gas channel 36*d* at a rate of 125 lit/min; and propane gas to the fuel gas channel 36*e* at a rate of 5 lit/min, respectively, and the gases were ignited using the pilot burner 16.

Subsequently, when nitrogen gas was supplied at random within the range of 0 to 150 lit/min to the raw gas channel 36*a*, the burner 3 constantly formed stable flames.

Further, when combustion was carried out continuously with nitrogen gas at a rate of 150 lit/min to the raw gas being supplied channel 36*a*, the cylindrical part 51 of the burner 3 did not become red hot.

As a comparative example, when the procedures of Test Example 2 were repeated using the apparatus employed in Test Example 2 and the burner 3 shown in FIG. 2, the burner 3 formed unstable flames when the flow rate of nitrogen gas supplied to the raw gas channel 36*a* was within the range of 40 to 60 lit/min.

TEST EXAMPLE 3

The same combustion type detoxifying apparatus as in Test Example 2 was employed to supply gases as follows: nitrogen gas containing 3% of silane to the raw gas channel 36*a* at a rate of 150 lit/min; nitrogen gas to the lift gas channel 36*b* at a rate of 10 lit/min; air to the raw gas combustion assisting gas channel 36*c* at a rate of 100 lit/min; air to the fuel gas combustion assisting gas channel 36*d* at a rate of 125 lit/min; and propane gas to the fuel gas channel 36*e* at a rate of 5 lit/min, respectively, and the gases were ignited using the pilot burner 16.

When the inside of the combustion chamber 1 was inspected after the apparatus was operated continuously under the above-described conditions for 24 hours, the powder generated during combustion of the silane gas had been deposited neither in the pre-combustion chamber 2 nor on the burner 3. Further, the silane concentration in the gas exhausted from the exhaust gas treating system was constantly less than 1/10 of the threshold limit value 5 ppm throughout the operation.

As a comparative example, when the procedures of Test Example 3 were repeated using the apparatus employed in Test Example 2 and the burner 3 shown in FIG. 2, powders were deposited on the inner surface of the pre-combustion chamber 2 to a maximum thickness of about 5 mm. The powders also were deposited slightly on the fuel gas combustion assisting gas nozzle 32*d* of the burner 3.

TEST EXAMPLE 4

A detoxifying treatment for removing silane was carried out employing a combustion type detoxifying apparatus having the structure shown in FIG. 8. The combustion chamber in this combustion type detoxifying apparatus had a double-wall structure having a height of 400 mm, consisting of a stainless steel inner barrel 61 having an outside diameter of 165.2 mm and a stainless steel outer barrel 11 having an outside diameter of 216.3 mm. Temperature sensors were provided in the gas preheating passage 62 and at the lower opening 17, respectively. Air for burning silane was allowed to flow through the gas preheating passage 62.

Gases were supplied to the burner 3 as follows: nitrogen gas containing 3% of silane from the raw gas supply pipe 37*a* at a rate of 150 lit/min; nitrogen gas from the lift gas supply pipe 37*b* at a rate of 10 lit/min; air from the raw gas combustion assisting gas supply pipe 37*c* and through the gas preheating passage 62 at a rate of 100 lit/min; air to the fuel gas combustion assisting gas supply pipe 37*d* at a rate 125 lit/min; and propane gas (LPG) from the fuel gas supply pipe 37*e* at a rate of 5 lit/min, respectively, and the gases were ignited using the pilot burner 16.

As a result, the temperature of the gas at the lower opening 17 of the combustion chamber was 730° C., and the temperature in the gas preheating passage 62 was 370° C. Further, a powder of silicon dioxide formed as a combustion product of silane was deposited on the inner surface of the inner barrel 61 when combustion treatment was continued. However, the powder was removed by injecting compressed air intermittently from the spray nozzle 64 without affecting the combustion treatment, nor the preheating of air and cooling of the inner barrel 61.

As a comparative example, a detoxifying treatment for removing silane was carried out under the same conditions as in Test Example 4, except that the combustion chamber consisted only of a stainless steel cylinder having an outside diameter of 165.2 mm and a height of 400 mm, and that air serving as the raw gas combustion assisting gas was supplied directly to the burner. As a result, the temperature of the gas at the lower opening 17 of the combustion chamber was 710° C., and the temperature of the circumferential wall of the combustion chamber was 400° C.

We claim:

1. A combustion detoxifying apparatus comprising:

a combustion chamber; and a burner for injecting a raw gas containing toxic components, an inert gas, a combustion assisting gas and a fuel gas into the combustion chamber;

the burner being a multi-wall pipe burner having a raw gas nozzle for injecting the raw gas, a lift gas nozzle for injecting the inert gas formed to surround the raw gas nozzle, a raw gas combustion assisting gas nozzle for injecting a gas for assisting combustion of combustible components in the raw gas formed to surround the lift gas nozzle, a fuel gas combustion assisting gas nozzle for injecting a gas for assisting combustion of the fuel gas formed to surround the raw gas combustion assisting gas nozzle, and a fuel gas nozzle for injecting the fuel gas, wherein the multi-wall pipe burner is attached to the combustion chamber via a pre-combustion chamber having a capacity which is smaller than that of the combustion chamber.

2. The combustion detoxifying apparatus according to claim 1, wherein the combustion assisting gas is injected from the fuel gas combustion assisting gas nozzle at a flow rate which is the same as or higher than the flow rate of the fuel gas to be injected from the fuel gas nozzle.

3. The combustion detoxifying apparatus according to claim 1, wherein a tip of the fuel gas combustion assisting gas nozzle and a tip of the fuel gas nozzle are formed to constitute an inverted V shape such that the nozzle holes of these nozzles open on the walls of the inverted V-shaped groove respectively to oppose each other.

4. The combustion detoxifying apparatus according to claim 1, wherein the combustion chamber has on an outer circumference a gas preheating passage for preheating at least a part of gases to be introduced to the burner.

5. The combustion detoxifying apparatus according to claim 1, wherein tips of the raw gas nozzle, lift gas nozzle and raw gas combustion assisting gas nozzle protrude beyond tips of the fuel gas combustion assisting gas nozzle and fuel gas nozzle.

6. The combustion detoxifying apparatus according to claim 5, wherein the tip of the fuel gas combustion assisting gas nozzle and the tip of the fuel gas nozzle are formed to constitute an inverted V shape such that the nozzle holes of these nozzles open on the walls of the inverted V-shaped groove respectively to oppose each other.

7. The combustion detoxifying apparatus according to claim 5, wherein the combustion chamber has on an outer circumference a gas preheating passage for preheating at least a part of gases to be introduced to the burner.

8. A method of detoxifying a gas containing toxic components in a combustion detoxifying apparatus having a combustion chamber; and a burner for injecting a raw gas containing toxic components, an inert gas, a combustion assisting gas and a fuel gas into the combustion chamber;

the burner being a multi-wall pipe burner having a first nozzle, a second nozzle formed to surround the first nozzle, a third nozzle formed to surround the second nozzle, a fourth nozzle formed to surround the third nozzle, and a fifth nozzle, comprising injecting into the combustion chamber a raw gas containing toxic components from the first nozzle, an inert gas from the second nozzle, a fuel gas from the fifth nozzle, a gas for assisting combustion of the raw gas from the third nozzle, and a gas for assisting combustion of the fuel gas from the fourth nozzle.

9. The method according to claim 8, wherein an auxiliary combustible gas is supplied with the raw gas.

* * * * *